US011701753B2

(12) United States Patent
Lonnecker

(10) Patent No.: US 11,701,753 B2
(45) Date of Patent: Jul. 18, 2023

(54) TILE DESIGN EROSION METHOD AND APPARATUS

(71) Applicant: Bruce Lonnecker, Golden, CO (US)

(72) Inventor: Bruce Lonnecker, Golden, CO (US)

( * ) Notice: Subject to any disclaimer, the term of this patent is extended or adjusted under 35 U.S.C. 154(b) by 0 days.

(21) Appl. No.: 17/553,417

(22) Filed: Dec. 16, 2021

(65) Prior Publication Data

US 2023/0191559 A1 Jun. 22, 2023

(51) Int. Cl.

| | |
|---|---|
| ***B44C 1/22*** | (2006.01) |
| ***B24C 1/04*** | (2006.01) |
| ***B24C 3/10*** | (2006.01) |
| *B24C 1/08* | (2006.01) |
| *B24C 1/06* | (2006.01) |

(52) U.S. Cl.
CPC ..... *B24C 1/04* (2013.01); *B24C 3/10* (2013.01); *B44C 1/22* (2013.01); *B24C 1/06* (2013.01); *B24C 1/08* (2013.01)

(58) Field of Classification Search
CPC ..... B44C 1/22; B24C 1/04; B24C 3/10
See application file for complete search history.

(56) References Cited

U.S. PATENT DOCUMENTS 4,443,500 A * 4/1984 deJori ..... B44C 1/221 451/29
2010/0003894 A1* 1/2010 Miller ..... C23C 4/18 451/75
2014/0290511 A1* 10/2014 Stecker ..... B44C 3/048 101/129
2020/0147952 A1* 5/2020 Duda ..... B41C 1/147

FOREIGN PATENT DOCUMENTS

CA 2865974 A1 * 1/2014 ..... B24C 1/04

* cited by examiner

*Primary Examiner* — Binh X Tran
(74) *Attorney, Agent, or Firm* — Cynthia S. Lamon; Lamon Patent Services

(57) ABSTRACT

A mesh spray erosion assembly includes a spray board having a length, a width, and a material thickness, a tile blank having a length, a width, and a material thickness supported on one side of the spray board, a mesh frame having a length and width greater than that of the tile blank, and a material thickness equal to or less than that of the tile blank, the mesh frame centered over the tile blank and mounted to the spray board, and a mesh screen having a length and a width, the mesh screen centered over the mesh frame and mounted thereon, the mesh screen including non-masked portions and masked portions, characterized in that a user may apply a pressurized liquid spray through the non-masked portions of the mesh screen against the surface of the tile blank eroding material from the surface thereof according to artist design.

18 Claims, 5 Drawing Sheets

TILE DESIGN EROSION METHOD AND APPARATUS

BACKGROUND OF THE INVENTION

1. Field of the Invention The present invention is in the field of art and design and pertains particularly to an erosion process dependent on a mesh spray apparatus for removing material from a substrate to produce a design formed by creating recesses in a thickness of the substrate similar to a bas-relief effect and or the reverse state of removing material to produce a sunken design similar to a sunken relief process.

2. Discussion of the State of the Art

In the field of art and design, clay forms have been produced by artisans throughout history. Techniques for creating a design into cement, ceramic or clay may include molding, sculpting, carving, shaping, looping, and stamping. For example, in modern design an artist might apply coloring and glazes onto ceramic tile with brushes or alternatively by spraying material onto a surface. Designs might be carved into the clay material by the artist using a well-known hand tool such as a loop tool, or a clay knife, etc.

In the art of production of clay and or ceramic or stone tiles, material relief effects are practiced in the art of sculpting and carving that may result in a design that is raised above the general surface plain of the substrate or a bas-relief effect known in the art, or that may result in a sunken relief effect also known in the art attributed to a design image that is sunken below the surface plain of the substrate.

Creating a raised design by removing material from a planar surface is an arduous and labor intensive process. For example, molds may be used to shape substrates like clay, which are difficult to work with. Some artisans opt to add material to the substrate to sculpt a raised design without having to remove material across wide swaths of the substrate.

Therefore, what is clearly needed is an apparatus and method that may produce a relief design effect using directed erosion in a permeable, pliable clay/ceramic material.

BRIEF SUMMARY OF THE INVENTION

According to an embodiment of the present invention, a mesh spray erosion assembly is provided including a spray board having a length, a width, and a material thickness, a tile blank having a length, a width, and a material thickness supported by the spray board, a mesh frame having a length and width greater than that of the tile blank, and a material thickness equal to or less than that of the tile blank, the mesh frame centered over the tile blank and mounted to the spray board, and a mesh screen having a length and a width, the mesh screen centered over the mesh frame and mounted thereon, the mesh screen including non-masked portions and masked portions, characterized in that a user may apply a pressurized liquid spray through the non-masked portions of the mesh screen against the surface of the tile blank eroding material from the surface thereof according to the artist's design.

In one embodiment, the tile blank is formed of clay. In one embodiment, the spray source for eroding material from the surface of the tile blank is a pressure sprayer having a pump including at least one inlet and at least one hose-connected spray wand with a spray head and nozzle. In one embodiment, the spray board and mesh frame are fabricated of wood. In one embodiment, the mesh frame is fabricated of aluminum. In one embodiment, the tile blank is supported by a recess formed in the spray board. In a preferred embodiment, the mesh spray erosion assembly is erected vertically during the spray erosion process. In one embodiment, the mesh screen is fabricated of a metal material, although in a preferred embodiment, the mesh would be manufactured from natural or synthetic mono or multi-filament fabric mesh similar to silkscreen. In one embodiment using the pressure sprayer, the spray nozzle is adjustable to widen or to narrow the spray.

A method for creating a design into a wet, pliable substrate having a front surface, a back surface, a length, width and thickness, a mesh screen spray erosion assembly is used in the method, the assembly including a sprayer, spray board, and a mesh screen frame. The method including the steps of (a) mounting of the mesh to a frame creating a screen; (b) preparation of the mesh screen with non-permeable masking material overlaid on portions of the mesh, thereby creating a design; (d) mounting of the substrate to one side of the spray board; (e) centering the screen over the tile blank on the spray board; (f) powering on a pressure spray system and setting an initial pressure spray profile; and (g) manipulating movement of a spray head of the pressure spray system, as required, to erode material from the thickness of the substrate according to the design on the mesh. In one embodiment of the method, the substrate is a clay tile having the length, width, and a thickness and may be pre-formed into a planar rectangular ribbon having a top surface and a bottom surface, and two opposing edges and a thickness and the clay tile is cut from the strip before or after the step of spraying.

Additionally, a step may be added for removing the mesh and adding color to the substrate and a step for drying the substrate occurs either before or after coloring. In one embodiment of the method, the mesh spray erosion assembly is erected vertically during the spray erosion process and the tile blank is supported by a recess formed in the spray board. One embodiment provides that some of the non-masked portions of the mesh screen are overlaid with a second mesh or stencil having apertures there through that are smaller than the apertures of the non-masked portions of the mesh screen.

DETAILED DESCRIPTION OF THE INVENTION

In various embodiments described in enabling detail herein, the inventor provides a unique system for producing designs in a permeable or soft substrate using a mesh-based spray erosion process. The substrate may be clay, cement, uncured or cured concrete, ceramic, and other substrates that may be pliable and capable of being eroded with a liquid under pressure. A goal of the present invention is to reduce time of tasking relative to manual clay design processes. Another goal of the present invention is to enhance repeatability of design in quasi commercial applications of design reproduction. The present invention is described using the following examples, which may describe more than one relevant embodiment falling within the scope of the invention.

Figure 1:
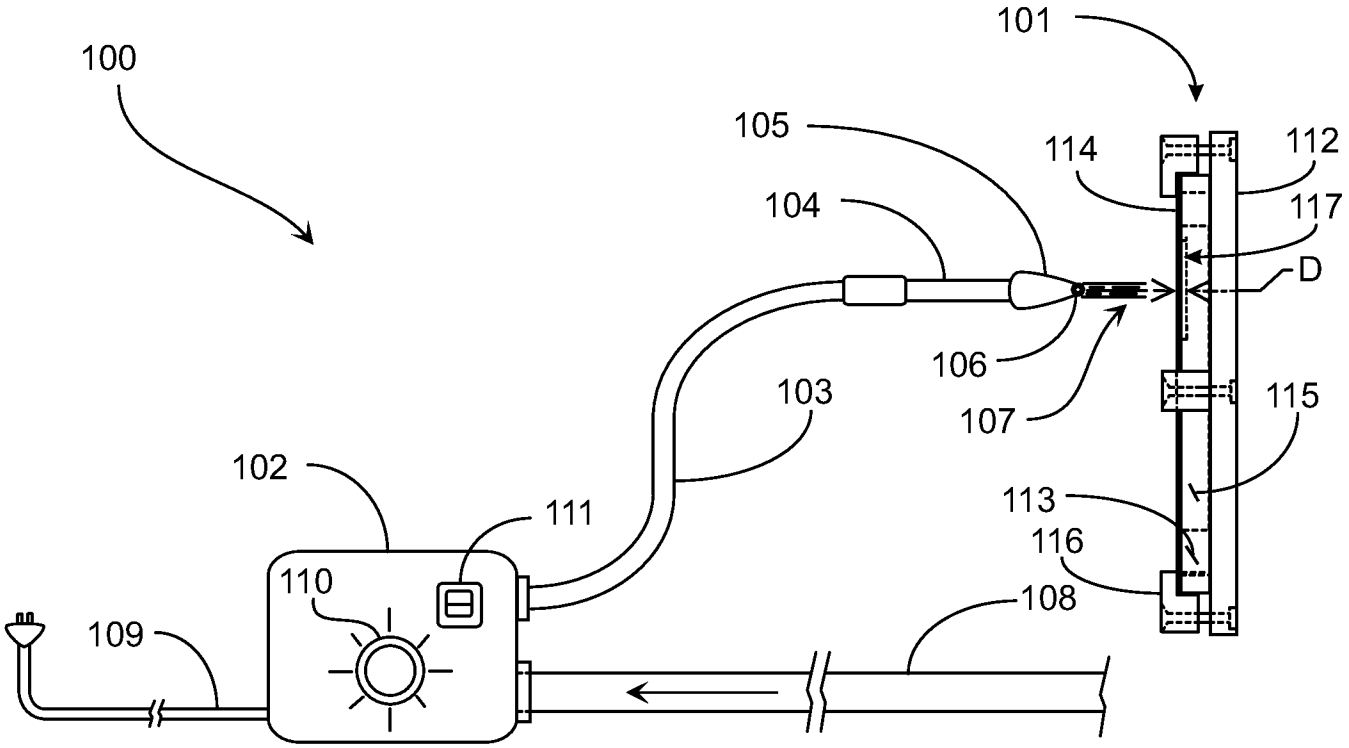
FIG. 1 is a block diagram of an erosion-based mesh design production apparatus according to an embodiment of the present invention.

FIG. 1 is a block diagram of an erosion-based mesh design production apparatus 100 according to an embodiment of the present invention. Apparatus 100 is adapted, in this embodiment, to be a manually controlled system for transferring an artist's design onto a soft or somewhat permeable clay or ceramic tile substrate 115 mounted in a mesh frame assembly 101 using a controlled and directed spray through the mesh printing assembly.

Mesh frame assembly 101 may be similar to mesh frames used for silkscreen printing processes. Mesh frame assembly 101 includes a rectangular frame 113 that may be manufactured of wood or aluminum, or another rigid material. Frame 113 has a uniform height dimension and a length and width dimension greater than that of a tile positioned to receive the transfer of design through a mesh screen 114. Mesh screen 114 may be composed of a stiff, resilient material, like aluminum or steel or a porous and durable fabric having a lower thread count and therefore larger uniform perforations or apertures than might be encountered with a traditional mesh or silkscreen material as are known in the art.

It may be noted herein that it is not required that mesh screen 114 be uniform relative to the number and size of apertures defining the mesh parameters. In one embodiment, mesh screen 114 may be modified with perforated mesh stencils representing artist design features that may be attached over the open (unmasked) portion of mesh screen 114 wherein the apertures of the mesh stencil are smaller than the apertures of mesh screen 114. Therefore, mesh screen 114 may include larger apertures, smaller apertures, and mask portions having no apertures according to an artist's intended design. It may be noted herein that larger apertures in mesh screen 114 allow liquid through more freely than mesh having smaller apertures. Aperture size in various mesh screens may be consistent on one screen or there may be more than one aperture size in a single mesh screen. Aperture sizes range from 0.005 to 0.015 inches, between 60 and 100 threads per linear inch (U.S. mesh) or 250-149 microns. It may follow then that a clay surface overlaid by non-masked areas of mesh screen 114 having larger apertures may erode faster than non-masked areas of mesh screen 114 having smaller apertures with the same water pressure and an equal distance between the spray wand and the substrate.

Mesh screen 114 may be attached at one side of mesh frame 113 in a manner that produces a stiff tension in the mesh material such as by stretching and clamping. In this embodiment, mesh screen 114 is placed over frame 113 and clamped to a spray backing board referenced herein as a spray board 112 using ledge clamps 116 at four corners and one each at each side of the frame assembly. Substrate 115 may be a soft slab of ceramic clay or clay of another type that may be sculpted, formed by rolling into a flat slab of uniform thickness that may be cut to prescribed length and width dimensions.

Substrate 115 may be positioned, typically at center position on spray board 112 wherein the position of placement of substrate 115 on spray board 112 is marked or otherwise formed to receive the substrate at the desired central position on the board. Likewise, mesh frame 113 may be clamped down over substrate 115 the frame centered over the substrate by placement markings or a form provided to receive frame 113 at the centered position. In one embodiment, substrate 115 is held in a rectangular depression machined in spray board 112, the rectangular depression having a uniform depth and a length and width sufficient to hold substrate 115 therein without clamping. However, substrate 115 may be lightly clamped to board 112 without departing from the spirit and scope of the present invention. Mesh frame assembly 101 including target substrate 115 may be placed or held upright during processing (design transfer) on a fence, in an easel, or by other structure to enable water and clay material to fall by gravity off of the substrate material as the design transfer process is being conducted.

Apparatus 100 includes a pressurized sprayer system including a pump 102, an inlet pipe or hose 108 connected at one end to pump 102 and at the other end to a source of water, for example a spigot or other specified liquid source. In one embodiment, pump/compressor 102 includes an electric cord and plug to drive a motor to pressurize the liquid before it is delivered from pump 102 through an outlet pressure hose 103, into a spray wand 104 having an adjustable spray head 105 and a spray nozzle 106. Spray wand 104 is adapted, in one embodiment, as a hand held instrument for delivering a pressurized and artist-directed spray through the non-masked portions of mesh screen 114 on mesh frame assembly 101 in manners that the spray contacts the permeable surface of substrate 115 and erodes material from the surface thereof to variable depth dimensions determined by the artist.

In one embodiment of the invention, there may be more than one spray wand 103 provided of different metrics whereby an artist may change spray wands during pauses in the process. Differences in spray wands may be attributed to length, diameter of wand body, design of spray nozzle, among other potential characteristics some of which are described further below. In one embodiment of the present invention, a pressure washing machine might be adapted with one or more stream adjustable spray wands that can be manipulated by the artist to manually erode the surface of substrate 115 over the mesh screen 114. In one embodiment, the sprayed medium is piped water.

In one embodiment, inlet pipe or hose 108 delivers water into pump 102 adapted to pressurize the water for directed and controlled spraying of the water through spray wand 104. In a variation of this embodiment, more than one inlet hose may be connected to pump 102 wherein one carries water and wherein another carries a second liquid to be introduced in a controlled manner into the water spray or to be compressed and sprayed separately from the water spray, perhaps using the same spray wand or a second spray wand dedicated for the second liquid. The second liquid may be a coloring agent, and erosion agent, a glaze material, paint, a lubricant, etc. Therefore, in one embodiment, apparatus 100 is adapted for eroding material from the surface of substrate 115 according to artist design transferred from mesh screen 114, and for introducing color, an erosion agent, a glaze, or a lubricant into the design process through the same non-masked portions of the mesh screen 114.

In this embodiment, pump 102 includes a power switch 111 adapted for powering the unit off and on. Pump 102 includes, in this embodiment, a pressure dial switch 110 adapted to enable the artist to increase or to decrease spray pressure. An artist may also manipulate spray head 105 on spray wand 104 to regulate the width and or angle of a pressurized stream of liquid emanating from spray nozzle 106. In one embodiment, spray head 105 may be threaded onto the body of spray wand 104 and the artist may advance or retard the direction of spray head 105 relative to the wand body to widen or to narrow a pressurized stream, depicted herein as stream 107 emanating from spray nozzle 106.

In this embodiment, an eroded area 117 of the surface of substrate 115 is depicted by broken boundary having a relatively uniform depth D measured from the accessible surface of mesh screen 114. Depth D may vary according to how much surface depletion was caused by erosion. It is noted herein that area 117 represents a second surface produced by erosion which may include slopes, valleys, and uneven areas relative to depth. In general practice described in more detail later in this specification, an artist may connect a hose or pipe line to pump 102 and plug in the unit to an electrical outlet, and switch it on to start building pressure for spraying. Assuming that the artist has created the mesh screen (rendering the desired non-masked portions) and has mounted the substrate and framing assembly to the spray board, the artisan may use spray wand 104 overall, or just the non-masked portions, of mesh screen 114 to erode to depth the surface of the underlying substrate 115.

It may be noted herein that the uniform thickness of substrate 115 is roughly equal to or just greater than the depth of mesh frame 113 so that mesh screen 114 is cross tensioned and presses against the flat surface of the substrate. The artist may manipulate spray wand 104 as desired, for example, using brush strokes, cutting pits or grooves, using wide slow strokes for uniform surface erosion, using angle of presentation to produce undercuts and slopes, and so on without limitation. Apparatus 100 may be scaled up or scaled down relative to size to accommodate different sizes or substrate.

Figure 2:
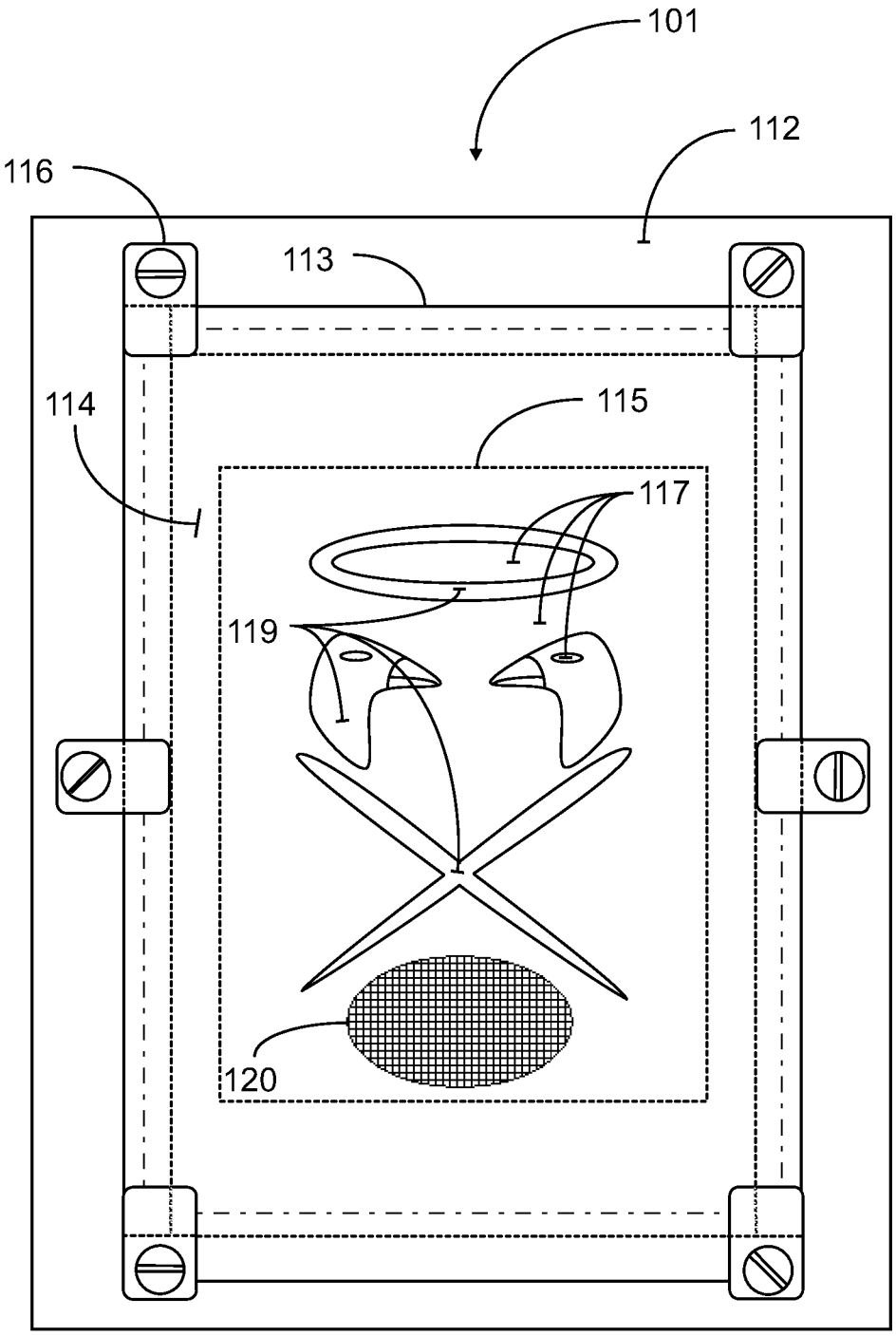
FIG. 2 is a front elevation view of the mesh apparatus and substrate of FIG. 1.

FIG. 2 is a front elevation view of the mesh apparatus 100 and substrate 115 of FIG. 1. In this view, frame assembly 101 is vertical and facing the viewer. Spray board 112 supports mesh frame 113 and mesh screen 114 in position around substrate 115 using ledge clamps 116. Ledge clamps 113 may be loosened or tightened by screw. Other clamping methods may be employed in place of clamps 116 without departing from the spirit and scope of the present invention. In one embodiment spring or toggle clamps may be provided.

In this embodiment, mesh screen 114 is non-masked in portions 117 and is masked or stenciled off in portions 119 to produce a design that will fit onto substrate 115. In one aspect, portions 117 may be open portions through mesh screen 114 resulting in spray contact with the surface of substrate 115. Portions 119, then, would be the masked portions closed off to pass through of water. A reverse state is feasible wherein portions 119 are open to water passage and portions 117 are not. It is noted herein that there may be a combination of masked and unmasked portions of mesh screen 114 that result in water passage to the clay surface to create a depressed background space, depressed outlines, borders, etc. and the associated bas-relief effect for the blocked off features of the design.

Mesh screen aperture count is referenced logically herein, as apertures 120. The micron size of mesh screen 114 will typically be uniform across the screen's surface area. In a preferred embodiment, screen 114 is reusable and may be provided in a variety thread counts (aperture sizes). A screen with fewer and larger apertures allows more water to pass through it un-obstructed whereas a finer weave (more and smaller apertures) breaks the stream up more smoothly for finer applications of the spray. In general use lower micro counts in mesh screen 114 may be desired depending on artistic requirements. In one embodiment, a substrate 115 may be processed by the artist using the spray wand(s) (not depicted) to erode the correct features and surfaces to create the intended design in the substrate wherein the artist determines progress and completion visually as the artist works. The artist may remove substrate 115 from assembly 101 by unclasping or otherwise disassembling the frame 113 and mesh screen 114 from spray board 112. The artist may then insert a new substrate into position and reattach or clamp the frame with mesh screen 114 back into position on the spray board. In this way an artist may produce a same erosion-based design on multiple substrates with design accuracy repetitiveness and in a shorter period.

Figure 3:
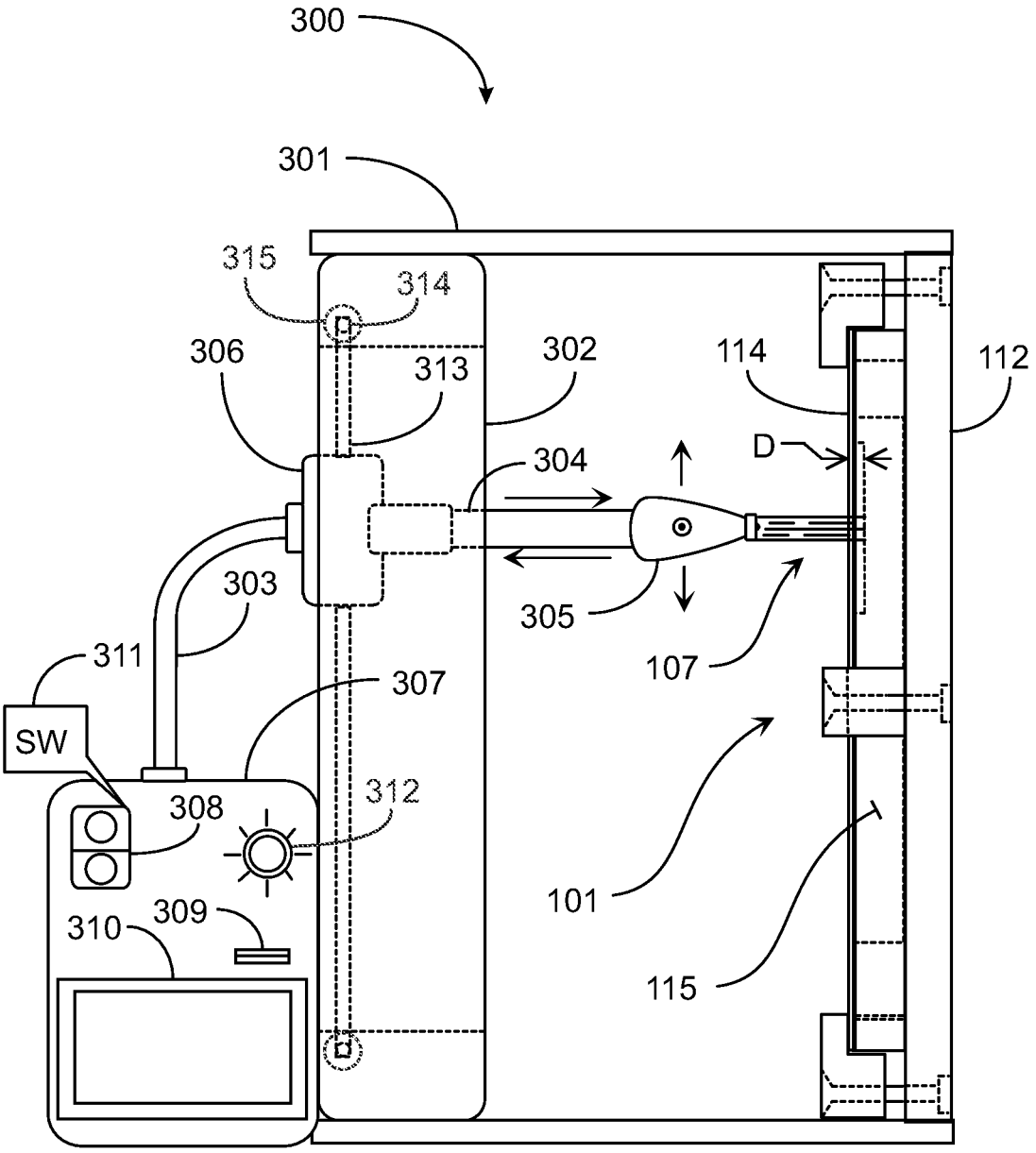
FIG. 3 is a block diagram of a mesh erosion-based design machine according to another embodiment of the present invention.

FIG. 3 is a block diagram of a mesh erosion-based design machine 300 according to another embodiment of the present invention. Machine 300 may be a robotic spray machine that includes mesh frame assembly 101 as a framed component. Machine 300 may include a box housing 301 (front panel removed for clarity). Housing 301 is adapted to hold mesh frame assembly 101 including splash board 112 held vertically, aligned to and facing a robotic rectangular machine frame having a same footprint area as the framing assembly. Housing 301 and robotic machine frame materials may be stainless steel sheet metal components.

In this embodiment, spray wand 104 may be chucked to or otherwise mounted to a robotic chuck assembly 306 that in turn may be adapted to travel up and down vertically along rod 313 and to and fro laterally (according to arrows) via a telescoping or slide apparatus, across the footprint area of mesh frame assembly 101. In this embodiment, chuck assembly 306 may travel vertically up and down over a threaded travel screw operated by motor similar to linear actuation. Horizontal travel screws 314 at top and bottom of the rectangular machine frame provide horizontal motion. Motor mounts 315 may be provided to operate the travel screws according to machine instruction. Machine 300 may include a pump 307 that may be further adapted with an actuating motor for operating linear actuators supported in the robotic frame enabling robotic movement of and positioning of spray wand 304 relative to two dimensions X and Y for covering the design footprint encompassing substrate 115 at center. In other embodiments, other robotic components may be provided and integrated with chuck assembly 306 and or spray wand 304 without departing from the spirit and scope of the present invention.

In one embodiment of the present invention, the spray wand body and or chuck assembly 306 may be telescopically adjustable to move spray wand 304 closer to framing assembly 101 or further back from it to a prescribed distance limit. In one embodiment, spray wand 304 included an adjustable spray head 305 that may be manipulated to produce a wider spray or a narrower spray as was described further above with apparatus 100 and spray head 105 of FIG. 1. In one embodiment, spray head 305 may be adjustable to set a particular angle offset from an orthogonal spray direction, the adjustment made to set a new angle of spray against the surface of substrate 115.

Pump 307 may be assumed to include at least one ingress hose or pipe for receiving water or another liquid, and an electrical cord and plug for connecting machine 300 to an electric power source power. In this embodiment, pump 307 includes an on/off power switch 308 and a pressure dial 312 allowing an artist to raise or lower the pressure of the spray system. In one embodiment, pump 307 includes a computer processing unit (CPU) 308 having an operating system, memory for processing, and software (SW) 311 for executing instructions resident on the machine memory or acquired to machine memory through an interface to another device having the instructions in the form of an executable file, for example. The instructions may be written code governing movement of the robotics and distancing between the spray wand 304 and frame assembly 101 during a run process of eroding a tile according to an artist's design and program instruction. SW 311 may also govern introduction of a second liquid from a second ingress line into the erosion process and or after the erosion process if color or glaze or another material is desired to be sprayed onto the eroded surface of substrate 115.

In one embodiment, machine 300 includes an optical recognition component like a camera (not depicted). The optical recognition component may capture a scaled or an original image of frame assembly 101 with a completed mesh screen 114 having all of the artistic design features represented thereon. In such an embodiment, an image of the design may be fed into a processor along with executable template data supplied by an artist. Executable template data may be submitted for a design using a universal serial bus memory device plugged into a USB port 309 on pump 307. Template data might include depth requirements or attribute of eroded surfaces including meta data describing various attributes of material used as an erodible substrate. For example, softer material may require less time, fewer passes, less pressure, etc. than harder material. Pump 307 may be provided with a visual display 310 that may provide a bird's eye view of a run against the substrate 115 as it is occurring. This may enable the artist to view the process and if necessary, pause the process to change (raise/lower) fluid pressure on pump 307, to adjust the spray head 305, to increase or decrease linear actuator speeds vertically or horizontally.

In one embodiment, machine 300 is a desktop machine that may support one or more frame assembly sizes. An artist may manually remove a frame assembly 101 from machine 300 and disassemble the spray board to remove the finished substrate and may load another blank substrate for processing in the same frame assembly. In one embodiment, in addition to optical recognition of the artist design, executable templates containing job or run instructions may be provided in the form of an executable file resident on a memory drive. In such as case, the machine 300 may execute the instructions once the artist plugs the drive into the pump 307.

In one embodiment, when all of the artist's design features are transferred into substrate 115, an audible sound may be played to alert the artist of a finished run. In another embodiment, a rack style conveyor may be provided that carries more than one frame assembly loaded with substrate, wherein the assembly is adapted to be indexed manually or automatically to move to a new substrate into correct position for run after a previous substrate is finished and wherein the mesh screen for the multiple batch run is the same screen removed and replaced onto the next frame assembly, or the mesh screen is unique to each subsequent frame assembly thereby producing a batch of tiles having variant artist designs transferred onto them.

In one embodiment, machine 300 may be disassembled to a state that allows the artist to take over manually with the robotics deactivated and moved out of the way of the work space. For example, a batch of tiles may be run having a same design produced commercially, and then the artist uses the manual version of the apparatus as described in FIG. 1 to finish certain details like painting and free form lining or the like. Finished tiles may be fired in one embodiment, to harden them for protecting the form and design. In one embodiment, hardening the tiles after erosion may be performed before painting, coloring, glazing, etc., which might be achieved with the same manually operated version of the machine or apparatus 100 of FIG. 1.

Figure 4:
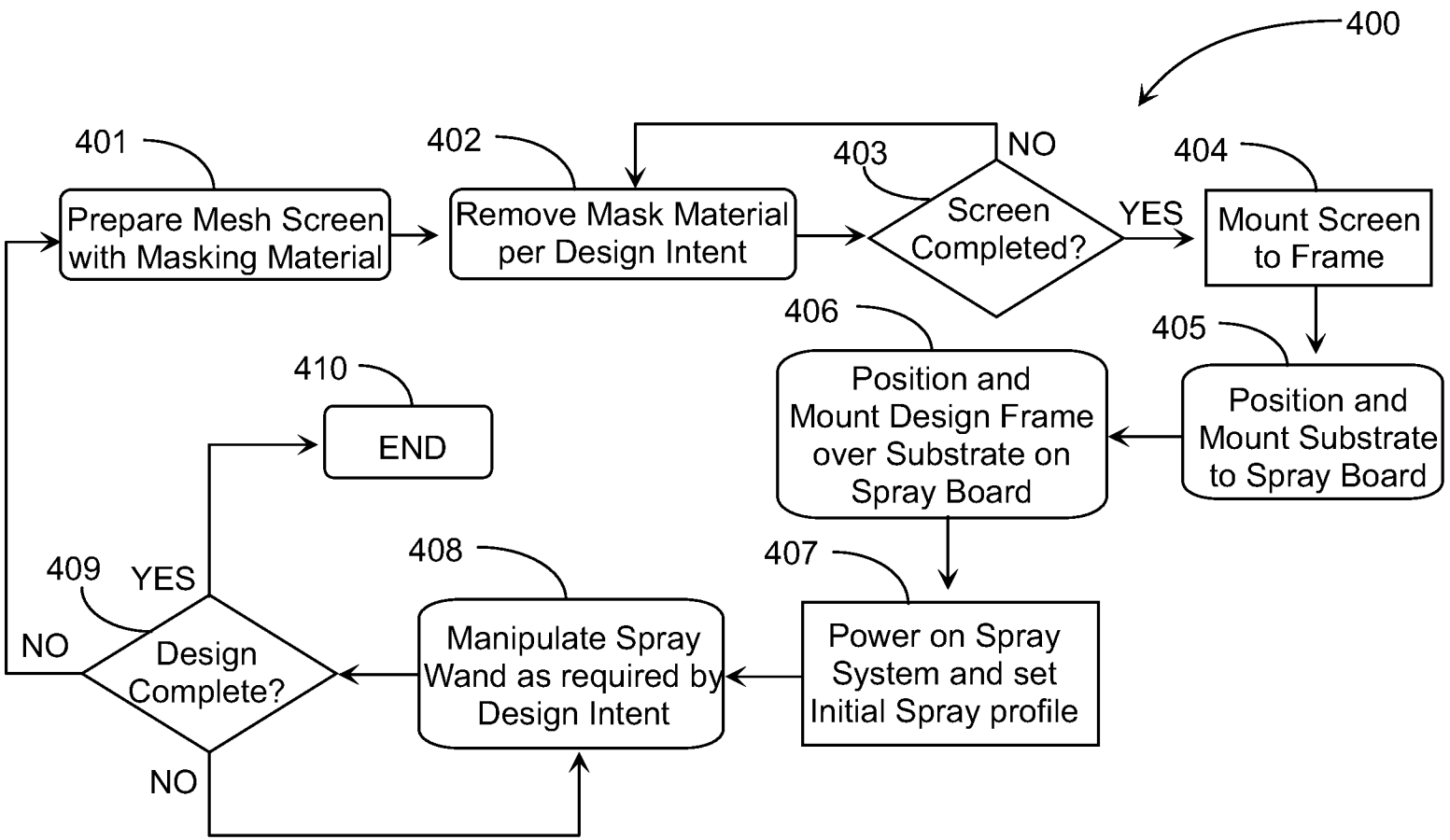
FIG. 4 is a process flow chart depicting steps for practicing mesh erosion-based design according to the embodiment of FIG. 1.

FIG. 4 is a process flow chart 400 depicting steps for practicing mesh erosion-based design according to the embodiment of FIG. 1. It is assumed in this example that the artist has already created a design for a clay substrate, and that the artist has a tile blank prepared as a substrate. At step 401, an artist may prepare a mesh screen with mesh masking emulsion material, typically covering at least one side of the mesh screen. In this step the artist may prepare one or more mesh screens used to create one design. In one embodiment, the material applied may be allowed time to dry. At step 402, the artist may remove masked material per design intent, the design transferred onto the mask material. It is noted herein that there are different ways and materials to mask a mesh screen and different ways to remove or otherwise open specific portions of the masked area per intended design.

At step 403, the artist may determine if the mesh screen is completed, meaning ready for use as a mesh containing the artist's design thereon. If at step 403, the artist determines that the mesh screen is not completed, the process loops back to the previous step 402. If at step 403, the artist determines that the mesh screen is complete and ready for run, then at step 404, the artist may mount the mesh screen over the mesh frame using clamps or other means of attachment. At step 405, the artist may position and mount the substrate onto the spray board. In this process, the spray board may have position markers and or a rectangular recess positioned to accept the substrate.

At step 406, the artist may position and mount the mesh frame over the substrate onto the spray board. In one embodiment, markers may be provided for locating or otherwise positioning the frame assembly in the correct position relative to the substrate. In this step, clamps may be provided on the spray board that the artist may leverage to clamp the mesh screen mesh frame over the substrate. In this process, the mesh may be tensioned across the frame assembly and the mesh screen may contact the untreated surface of the substrate with some force to prevent water from going under masked portions of the mesh screen and contacting the surface of the substrate in areas of the design where no erosion is desired.

At step 407, the artist may power on the spray system and set the initial spray profile, which may include setting water pressure, stream width, stream angle, amongst other metrics. At step 408, the artist may utilize the spray wand manually to perform the erosion process. The artist uses the spray wand to visually direct the eroding stream through open or partly open areas of the mesh screen transferring the artist's design onto the surface of the substrate by removing material from the surface of the substrate according to design. At step 409, the artist may determine if the design transferred onto the substrate is complete with respect to eroding the surface of the substrate according to design.

If at step 409, the artist determines visually that the design transfer process is completed for that substrate, the process may end at step 410. A completed design refers only to the process of design transfer through water or liquid erosion. Other tasks may continue using the spray wand and a second material like paint, ink, glaze, or other potential sprayable materials that may be part of the overall design. A second material may be introduced through the spray wand used for eroding the surface of the substrate or a different spray wand. Moreover, the artist may swap out the mesh screen used to produce the bas-relief or relief design with another having different mask metrics of the same or different design, for example, for coloring, glazing, coating, or other material processes.

Figure 5:
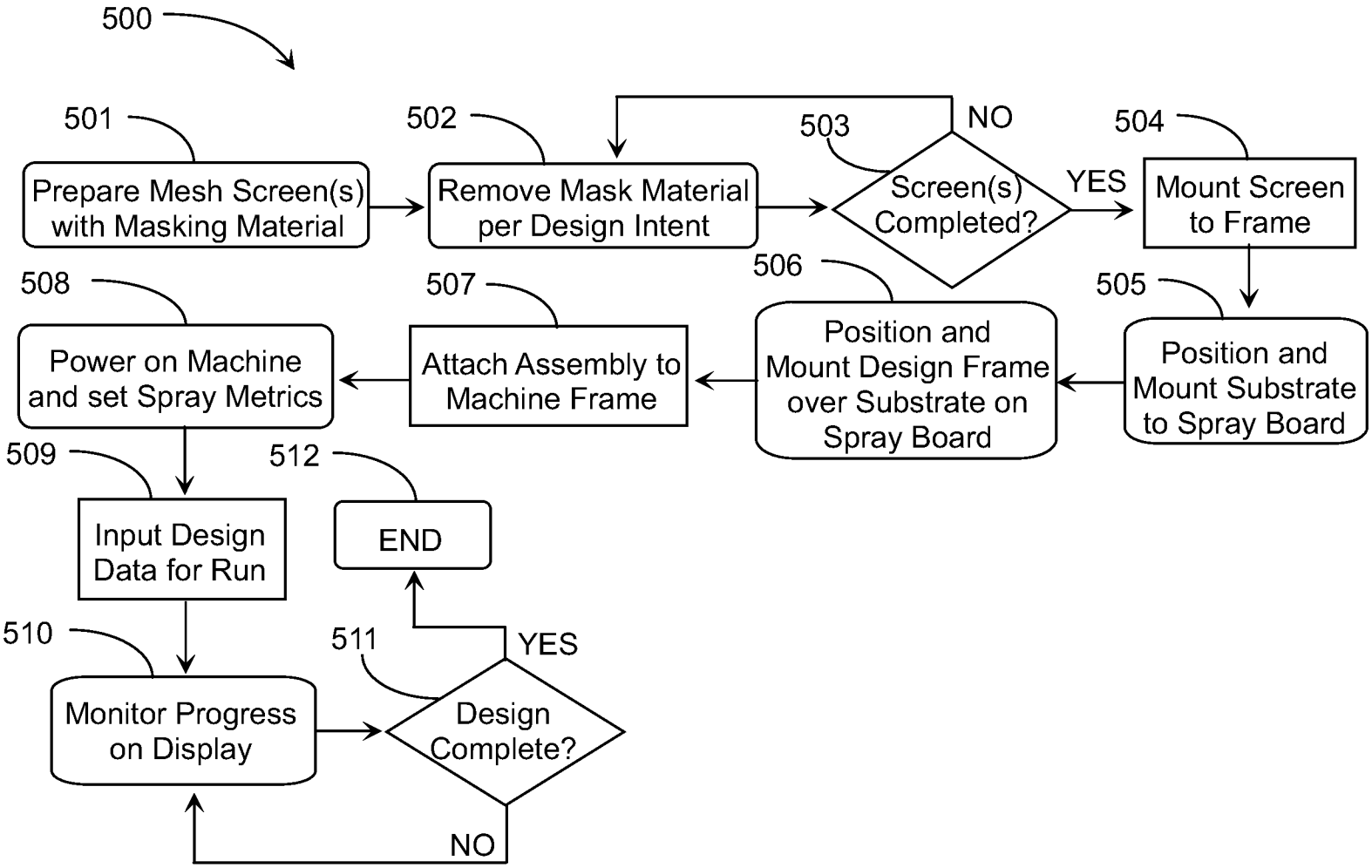
FIG. 5 is a process flow chart depicting steps for practicing mesh erosion-based design according to the embodiment of FIG. 3.

FIG. 5 is a process flow chart 500 depicting steps for practicing mesh erosion-based design according to the embodiment of FIG. 3. It is assumed in this example that the artist has already created a design for a clay substrate, and that the artist has a tile blank prepared as a substrate. In this process that is partly automated, the artist completes steps 501 through step 506 in the same fashion as described with respect to steps 401 through 406 in the process flow chart 400 depicted in FIG. 4. At step 507, the artist mounts or otherwise attaches the frame assembly containing the substrate onto the machine frame opposite of the sprayer mechanics as is depicted in FIG. 3 machine 300. Methods of attachment may include magnetic interface, clamps, screw/nut hardware, retainer pins, or the like.

At step 508 the artist may power on the machine and set initial spray metrics as described above with respect to process chart 400, step 407 of FIG. 4. In one embodiment, the artist may not be required to set initial spray metrics as an executable file input to the machine may contain those instructions. At step 509, the artist may input design data into the machine through use of an executable file and or a scale image of the mesh screen design uploaded to the machine from a memory stick like a USB device. In one embodiment, the artist may upload an executable file containing run instructions and meta data. Run instructions may include travel speed, water pressure, pass time, passes per section, water temperature, and the like. Meta data may include material properties, design boarder information, number of tiles in batch, and so on.

In one embodiment, the optical components of the machine see the artist's masked design and navigates according to executable code and by proximity. At step 510, the artist may watch the process occurring in real time on a visual display that, in one embodiment, may be extended to a second larger display on a second device. The artist may pause the process or stop the process or reset the process at any time during the process run. In one embodiment, the artist may be able to request additional passes of the spray wand, or extend the time period for a sub-process while it is in progress through computing input indicia like a keyboard or special buttons provided for the dedicated purposes.

At step 511, the artist may determine if the design process is complete. In one aspect, an audible sound or a visual indication on display may inform an artist the mesh eroding process is completed for the substrate. In one embodiment, the artist may visualize progress on display and make the determination that the process is sufficiently completed before the run time has expired for the process, and may stop the process manually.

If at step 511, the artist determines that the process is complete for the substrate, then the process may end at step 512. If at step 511, the artist determines the process is not complete, the process may loop back to step 510. Like the process of FIG. 4, the process of FIG. 5 is only relevant to removing material by eroding the material from the substrate surface according to artist design.

As referenced above for the process of FIG. 4, a completed design refers only to the process of design transfer through water or liquid erosion. Other tasks may continue using the spray wand and a second material like paint, ink, glaze, or other potential spray able materials that may be part of the overall design. A second material may be introduced through the spray wand used for eroding the surface of the substrate or a different spray wand. Moreover, the artist may swap out the mesh screen used to produce the bas-relief or relief design with another having different mask metrics of the same design, for example, for coloring, glazing, coating, or other material processes.

It will be apparent with skill in the art that the mesh tile design erosion methods and apparatus of the present invention may be provided using some or all the elements described herein. The arrangement of elements and functionality thereof relative to the aggregate subject matter of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A mesh spray erosion assembly comprising:

a spray board having a length, a width, and a material thickness;

a tile blank formed from uncured clay material, having a length, a width, and a material thickness supported on one side on the spray board;

a mesh frame having a length and width greater than that of the tile blank, and a material thickness, the mesh frame centered over the tile blank and mounted to the spray board;

a mesh screen having a length and a width, the mesh screen centered over the mesh frame and mounted thereon, the mesh screen including non-masked portions and masked portions; and a pressure sprayer system having a pump including at least one inlet and at least one hose-connected spray wand with a spray head and spray nozzle, wherein the at least one inlet connected to the pump at a first end and connected to a source of liquid at a second end;

wherein the mesh spray erosion assembly enables application of a pressurized liquid over the mesh screen against the surface of the tile blank thereby eroding the uncured clay material from the surface thereof.

2. The mesh spray erosion assembly of claim 1, wherein an amount of the uncured clay material removed from the tile blank is regulated by adjusting pressure of the liquid exiting the spray nozzle.

3. The mesh spray erosion assembly of claim 1, wherein some of the non-masked portions of the mesh screen are overlaid with a stencil having apertures there through that are smaller or larger than the apertures of the non-masked portions of the mesh screen.

4. The mesh spray erosion assembly of claim 1, wherein the spray board and mesh frame are fabricated of wood.

5. The mesh spray erosion assembly of claim 1, Wherein the mesh frame is fabricated of aluminum.

6. The mesh spray erosion assembly of claim 1, wherein the tile blank is supported by a recess formed in the spray board.

7. The mesh spray erosion assembly of claim 1 erected vertically during a spray erosion process.

8. The mesh spray erosion assembly of claim 1, wherein the mesh screen is fabricated of a metal material or silkscreen fabric.

9. The mesh spray erosion assembly of claim 1, wherein the spray nozzle is adjustable to widen or to narrow spray emitted from the spray nozzle.

10. A method for creating a design into a wet, pliable tile blank, having a front surface, a back surface, a length, width and thickness, using the mesh screen spray erosion assembly of claim 1, the method including the steps of:

(a) mounting of a mesh to a mesh frame thereby creating the mesh screen;

(b) preparation of the mesh screen with non-permeable masking material overlaid on portions of the mesh screen, thereby creating a design;

(c) mounting of the tile blank to one side of the spray board;

(d) centering the mesh screen over the tile blank on the spray board;

(e) powering on the pressure sprayer system and setting an initial pressure spray profile; and (f) manipulating movement of the spray head of the pressure sprayer system, over the mesh screen and a first surface of uncured tile blank, to erode the uncured clay material from the thickness of the tile blank according to the design on the mesh screen, wherein the first surface of tile blank is either the front surface or the back surface.

11. The method of claim 10, wherein the tile blank is pre-formed into a planar rectangular ribbon having a top surface and a bottom surface, and two opposing edges and a thickness and the tile blank is cut from a strip after the step of spraying.

12. The method of claim 10, wherein the mesh spray erosion assembly is erected vertically during the spray erosion process.

13. The method of claim 10, wherein the tile blank is supported by a recess formed in the spray board.

14. The method of claim 10, further including a step for masking, mounting and spraying a second surface, wherein the second surface opposite the first surface.

15. The method of claim 10, wherein some of the non-masked portions of the mesh screen are overlaid with a stencil having apertures there through that are smaller or larger than the apertures of the non-masked portions of the mesh screen.

16. The method of claim 10, further comprises a step (h) removing the mesh screen and adding color to the tile blank.

17. The method of claim 16, further comprises a step for drying the tile blank, wherein the drying step occurs either before or after coloring.

18. The method of claim 16, wherein the spray nozzle is angularly adjustable.

* * * * *